US006148880A

United States Patent [19]

Dehde et al.

[11] Patent Number: 6,148,880

[45] Date of Patent: Nov. 21, 2000

[54] FLAT-SURFACE MILLING MACHINE

[75] Inventors: Jörg Dehde, Steinenbronn; Maximilian Ober, Jettenbach; Frieder Scholz, Fischbachau, all of Germany

[73] Assignee: Robert Bosch GmbH, Stuttgart, Germany

[21] Appl. No.: 09/254,895

[22] PCT Filed: Jun. 18, 1998

[86] PCT No.: PCT/DE98/01674

§ 371 Date: Aug. 3, 1999

§ 102(e) Date: Aug. 3, 1999

[87] PCT Pub. No.: WO99/03655

PCT Pub. Date: Jan. 28, 1999

[30] Foreign Application Priority Data

Jul. 14, 1997 [DE] Germany ..... 197 30 087

[51] Int. Cl.[7] ..... B27C 1/00

[52] U.S. Cl. ..... 144/118; 30/477; 144/154.5; 144/219; 144/234; 144/114.1; 144/241; 409/182

[58] Field of Search ..... 30/477; 144/136.95, 144/137, 154.5, 218, 234, 235, 236, 114.1, 115, 118, 150, 119.1, 241; 409/178, 179, 180, 182

[56] References Cited

U.S. PATENT DOCUMENTS

| | | | |
|---|---|---|---|
| 1,329,383 | 2/1920 | Eaton | 30/477 |
| 1,817,197 | 8/1931 | Kerns | 144/219 |
| 2,395,158 | 2/1946 | Yandell | 30/477 |
| 2,785,713 | 3/1957 | Wagner | 144/234 |
| 2,839,108 | 6/1958 | Retz | 144/118 |
| 2,915,095 | 12/1959 | Pelto | 144/219 |
| 3,381,728 | 5/1968 | Goldstein | 144/219 |
| 3,504,434 | 4/1970 | Thomsen | 30/477 |
| 4,675,975 | 6/1987 | Kucharczyk et al. | 144/219 |
| 5,899,252 | 5/1999 | Pozzo | 144/137 |

*Primary Examiner*—W. Donald Bray
*Attorney, Agent, or Firm*—Kenyon & Kenyon

[57] ABSTRACT

A planer-type face milling machine for processing wood having a drive motor that is coupled to a work spindle, which supports, on a free end, a milling head, which on its front side supports cutting edges, the milling head being configured particularly as a disk-shaped body, running parallel to the workpiece surface, the milling cutting edges being supported by a cutter, particularly a planar one, furnished with main and secondary cutting edges, and removably arranged on the milling head, is configured as a particularly effective and-tool machine in that the planer-type face milling machine is correspondingly small and light and has a housing having a handle, the milling head supporting a cutter without a main cutting edge and having only at least one secondary cutting edge.

20 Claims, 6 Drawing Sheets

FLAT-SURFACE MILLING MACHINE

FIELD OF THE INVENTION

The present invention is based on a planer-type face milling machine.

BACKGROUND INFORMATION

In the technical journal HK 6/94 reference is made on page 762 to a multiple disk saw K34G/1200, which is provided with special separating cutters, which simultaneously saw and plane the wood. These separating cutters carry two types of teeth, reaming teeth and planing teeth. The reaming teeth, which are arranged radially on the furthest periphery of the separating cutter, only perform the cutting work using a major cutting edge. For every two reaming teeth there follows a planing tooth, which, using an axial cutting edge, provides a secondary processing to the already reamed surface of the cut, left somewhat rough by the saw. The cut surfaces of the sawed pieces are very smooth in areas, although, depending on the methods, minimal but clearly visible ring-shaped indentations can occur. As a result, it is not possible in every case to do without a secondary processing, such as planing, before the lacquering or waterproofing.

German Patent No. 195 43 992 describes a conventional hand milling machine, using which thin layers of the wood material, in particular old lacquer layers, can be removed. The surface quality that can be attained in this way is relatively coarse, so that it is impossible to lacquer or to waterproof without a subsequent milling process such as polishing or the like. The conventional machine thus represents a face milling machine having conventional cutting geometry, which does not achieve the performance of a planer-type face milling machine.

The conventional stationary planer-type face milling machines result in an inferior surface quality in the planing of the end piece and in the planing teeth emerging from the workpiece, because, in this context, a situation arises in that the edge tears out of the wood relatively coarsely.

SUMMARY OF THE INVENTION

A planer-type face milling machine according to the present invention has the advantage that all the surfaces, including end surfaces and edges, can be machined at a level of quality previously unattainable with any type of planing and cutting machines.

The planer-type face milling machine of the present invention, in addition, has the advantage that it can be utilized as a hand tool machine for the final processing of wood workpieces which are too large and too heavy for processing on stationary machines. In this way, the new planer-type face milling machines can be advantageously used also for the final processing of finished-installed wooden panels and wooden floors, or in the restoration of furniture, shavings being formed predominantly without a dust component, i.e., without generating the fine dust which is difficult to filter and is dangerous to health.

As a result of the fact that the milling head has only a single cutter having only one operative secondary cutting edge and lacking an operative main cutting edge, a surface processing is assured that has final quality, the assembly/adjustment or changing cutters being particularly simple as a result of there being only one single circular path.

As result of the fact that a second cutter can be arranged having only one operative main cutting edge, a coarse-machining preliminary cutting using the second cutter is possible resulting in a shaving thickness of approximately 3 mm, and a subsequent cutting using the first cutter is possible resulting in a shaving thickness of approximately 0.3 mm making removal very effective and surface quality high.

As result of the fact that the secondary cutting edge has a predominantly clothoid-shaped area which is to penetrate in a cutting manner into the workpiece being processed, the area tangentially passing over into a non-clothoid-shaped area which is not to penetrate in a cutting manner into the workpiece, cut surfaces are produced that are particularly clean and smooth.

As result of the fact that the two different cutters on the milling head can be mounted on diametrically opposite sides, a not unbalanced milling is possible.

As result of the fact that the cutting edges are level planar bodies which can be arranged with their narrow sides facing the workpiece at the cutting head and extending beyond its front side, manufacturing the cutters and the milling head independently from one another is particularly favorable economically.

As a result of the fact that the angle between the axis $\lambda n$ of the second cutter, i.e., of the cutter having the secondary cutting edge, corresponds to the vertical projection of the secondary cutting edge into the x-y plane, that $\lambda n=45°$ to 75° is arranged with regard to a radial in the x-y plane determined by the front side of the milling head, the radial having an angle open in the direction of rotation (FIG. 5), that, in this context, the secondary cutting edge, having an angle of inclination $\lambda=45°$ through 75° (FIG. 6) in relation to the Z-axis defined vertically on the front side of the milling head, is arranged so as to project over the front side, and that the secondary cutting edge has a cutting angle $\gamma n$ and between 20° and 30° and a wedge angle $\beta n$ between 50° and 55°, a machining using the secondary cutting edge is assured that is free of torn edges and of high quality. In addition, the work spindle, placed at an angle less than 90° with respect to the base plate, contributes to this, the spindle causing the cutters to penetrate into the workpiece at first relatively deeply as result of its angle, but causing them to be withdrawn from the workpiece at an ever flatter angle.

As result of the fact that the secondary cutting edge has a draft angle an between 10° and 20°, a clean removal of shavings is assured, large shavings being produced without dust.

As a result of the fact that the major cutting edge radially engages the workpiece surface roughly 0.5 to 5 mm further to the outside than the secondary cutting edge, a particularly effective preliminary cutting using the main cutting edge, and a qualitatively excellent secondary cutting using the secondary cutting edge, are possible.

As a result of the fact that the milling head of the planer-type face milling machine of the present invention is operated at a rotational speed of approximately 10,000 RPM, at least one of the cutters defining a circular path having a diameter of 80 mm, it is possible to obtain an optimal value between milling speed and surface quality.

As result of the fact that the milling head operates with superbly clean cutting quality even with one single cutter that carries only one single operative secondary cutting edge, a milling is possible without an additional milling process, the milling head being able to be manufactured particularly economically.

DETAILED DESCRIPTION

Figure 1:
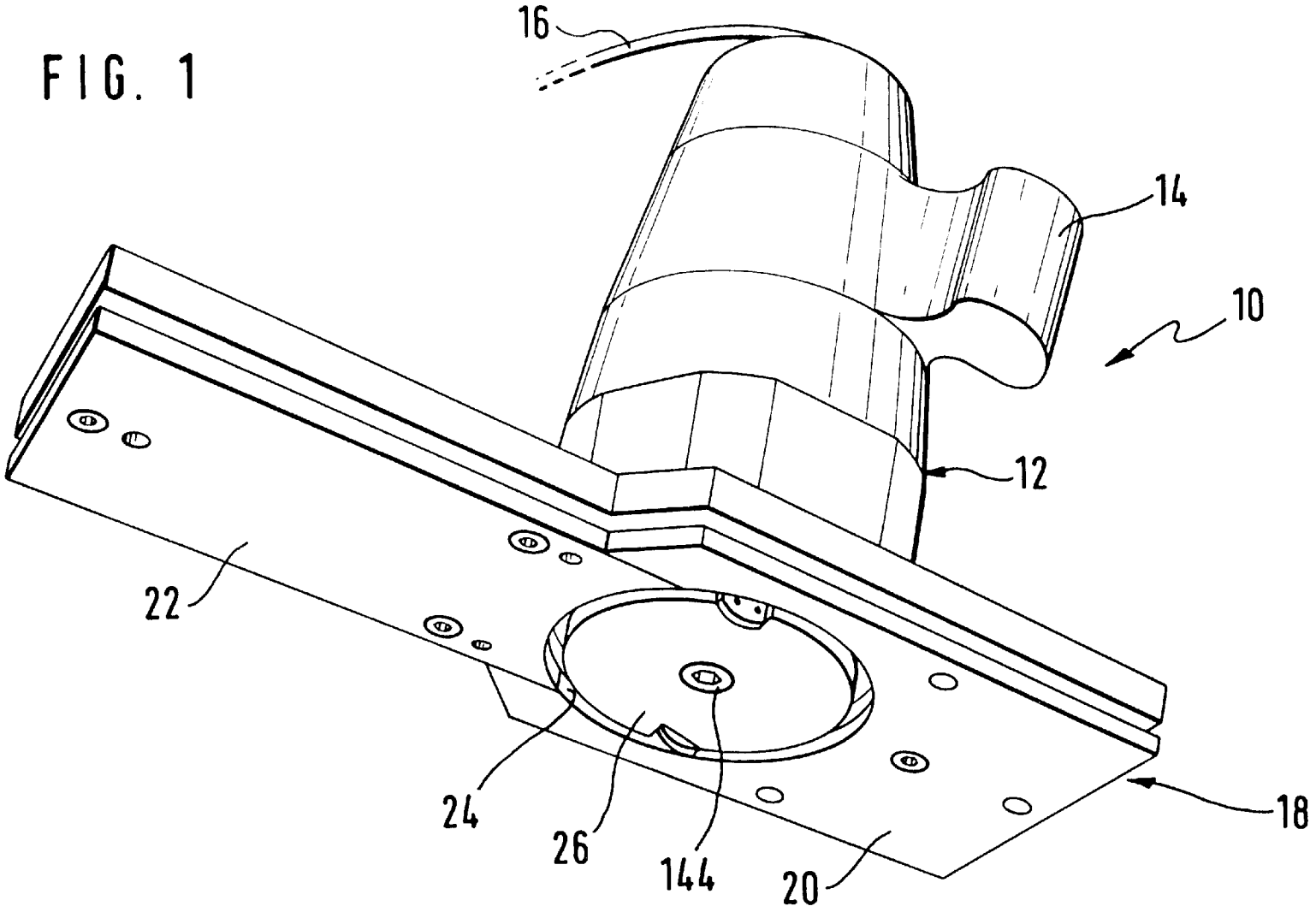
FIG. 1 shows an exemplary embodiment of a planer-type face milling machine according to the present invention.

Planer-type face milling machine 10, depicted spatially in FIG. 1, has a roughly cylindrical housing 12, extending axially, from the viewpoint of the observer, from top to bottom. The housing supports a mains cable 16, emerging at the top, and two handles 14 protruding laterally and radially, of which only one is depicted, for guiding planer-type face milling machine 10 on an undepicted workpiece.

The lower area of housing 12 is joined to a base plate 18 for support on a workpiece, the base plate being composed of a front, axially displaceable, wide part 20 and a rear, stationary, narrow part 22. Base plate 18, in an axial elongation of housing 12 is provided with a circular through-opening 24 permitting a disk-shaped milling head 26 to pass through in order to engage for milling purposes in the undepicted workpiece. Through-opening 24 is arranged between parts 20, 22 of base plate 18, a relatively small area of this opening 24—on the left from the viewpoint of the observer— being constituted out of the edge of the narrow or, stationary part 22, and a larger area out of the edge of the wider, movable part 20, movable part 20 partially encompassing the external contour of stationary part 22.

Figure 3:
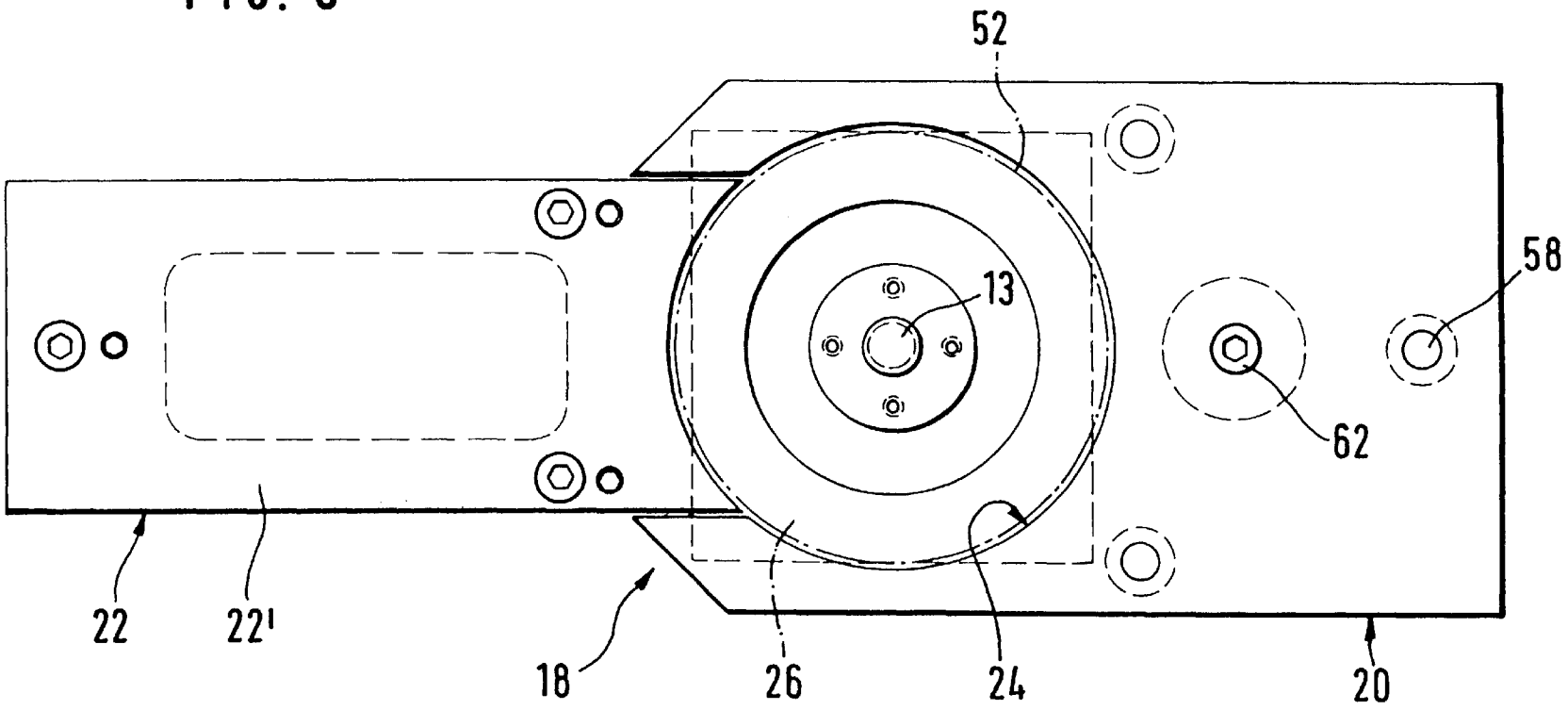
FIG. 3 shows a bottom view of the base plate.

Movable part 20 of base plate 18 can be displaced along the axis of cylindrical housing 12, with regard to housing 12 and with regard to milling head 26, whose cutting edges run roughly flush with the lower surface of stationary part 22. The displacement path of movable part 20, in relation to stationary part 22, determines the shaving thickness during face-milling cutting. Movable part 20 of base plate 18 is wider, and stationary part 22 is narrower than the diameter or circular path 52 of disk-shaped milling head 26 (FIG. 3).

Figure 2:
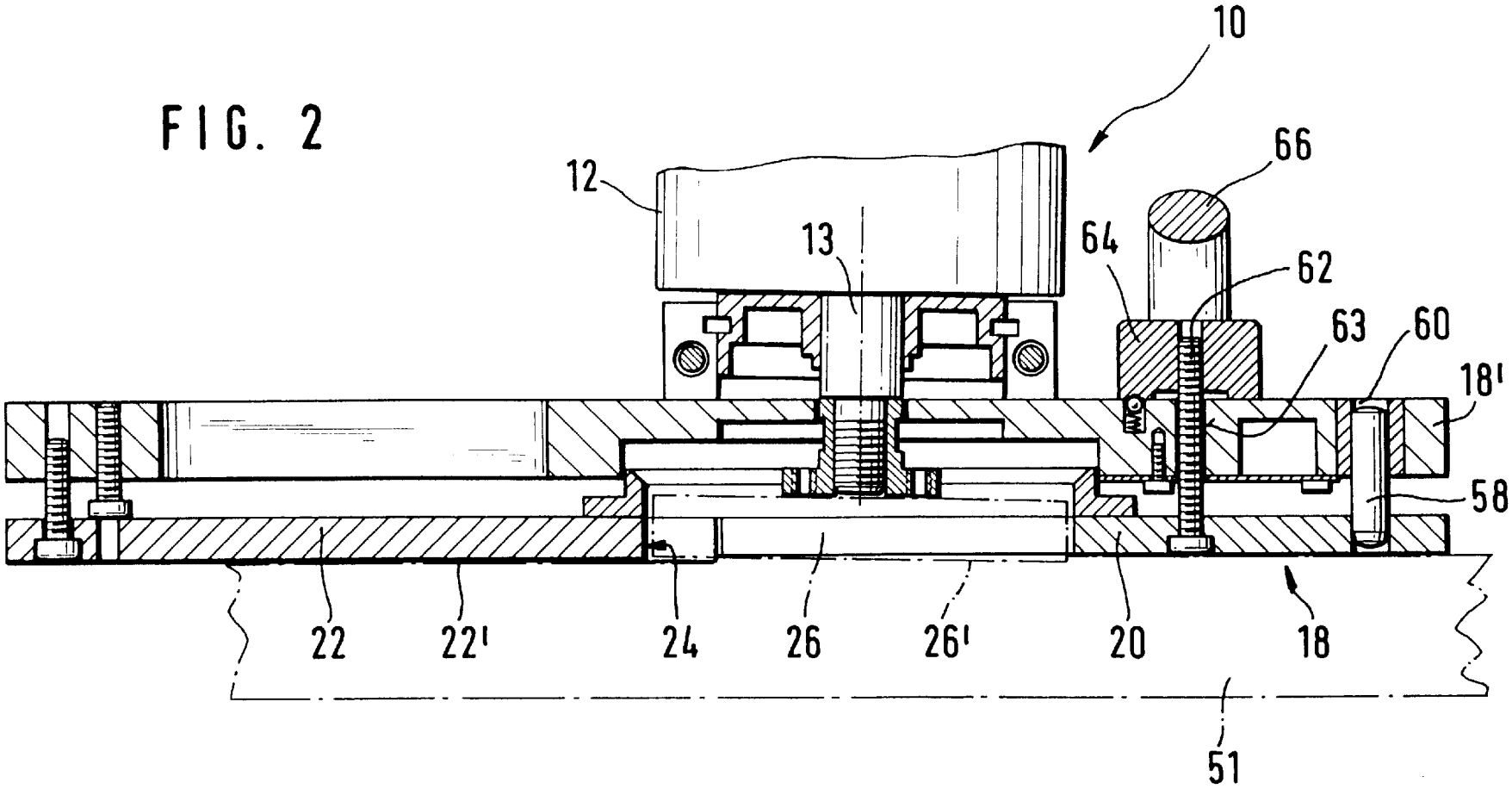
FIG. 2 shows a partial longitudinal section of the planer-type face milling machine according to FIG. 1 in the area of the base plate.

FIG. 2 shows a longitudinal section of planer-type face milling machine 10 in the area of base plate 18, resting on a workpiece 51, stationary part 22 being recognizable at the lower left, from the viewpoint of the observer, and displaceable part 20 on the right from the viewpoint of the observer. Between stationary and displaceable parts 20,22, through-opening 24 can be recognized, which narrowly encloses the periphery of milling head 26, designated by a dot-dash line, at the free end of work spindle 13, it being only sketched in the drawing that work spindle 13 having milling head 26, supported on the latter at a right angle, is angled slightly to the front, with respect to base 22' of stationary part 22 of base plate 18. In this manner, milling head lower edge 26', on the side of milling head 26 that faces away from the feed direction, runs inside base 22' of stationary part 22, so that, from the viewpoint of the observer, the cutting edges of milling head 26 have a smaller cutting depth in the rear than in front, with regard to the workpiece being processed. In this way, the cutting edges of milling head 26 exit in the rear only slowly and smoothly from the area of the workpiece previously milled in a processing by the front area of milling head 26. In this way, the tearing out of shavings, along with a corresponding reduction in processing quality is avoided.

Displaceable part 20 of base plate 18 supports a guide pin 58, which engages in a guide bore 60 in a set-apart area of base plate 18 and assures the positioning of the latter without play.

Set-apart, parallel to guide pin 58 in part 20, a spindle-shaped threaded bolt 62 is non-rotatably anchored, extending through set-apart upper area 18' of base plate 18, and being embraced at its free end by an adjusting nut 64, which is non-rotatably joined to an adjusting handle 66. In accordance with the rotational direction of adjusting nut 64 with the assistance of adjusting handle 66, displaceable part 20 is displaced upwards or downwards, parallel with regard to the upper area of base plate 18. In this way, displaceable part 20 of base plate 18 releases the area of milling head 26 lying in the feed direction in order to engage in a workpiece 51 for milling purposes.

FIG. 3 shows a view from below of base plate 18 having displaceable and stationary parts 20,22. In this context, it can be seen that through-opening 24 is predominantly formed by a curved cut-out in displaceable part 22, whereas the small area of the through-opening is formed by a partially circular curvature in stationary part 20.

To operate planer-type face milling machine 10, it is placed with displaceable part 20 of base plate 18 onto workpiece 51. In this context, displaceable part 20 is set back axially with regard to milling head 26, to the extent that a shaving thickness of 0.1 to 0.5 mm can be attained, and the planer-type face milling machine is securely resting. After the undepicted switch is switched on, the energy supply to the motor is switched on, so that the latter sets milling head 26 in rotating motion. As planer-type face milling machine 10 is advanced to the right from the viewpoint of the observer, milling head 26 engages in the undepicted workpiece for milling purposes. Once milling head 26 has passed over the workpiece across its entire breadth, then the rear, stationary area of the base plate comes to rest on the just processed area of the workpiece. A particularly stable positioning of base plate 18 on workpiece, as well as uniform, reliable face milling are now assured.

Figure 4:
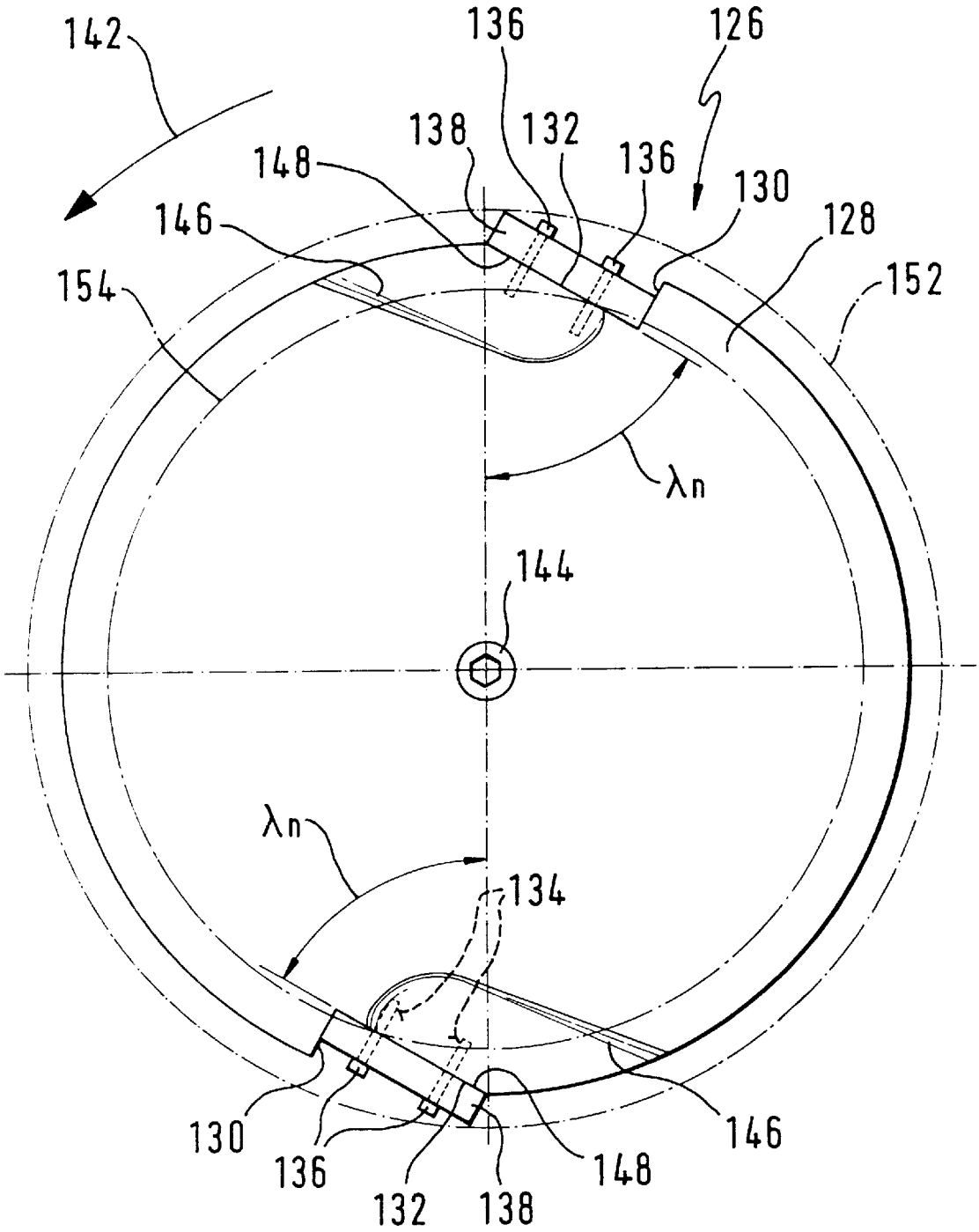
FIG. 4 shows the front side of a milling head having two identical cutters.

FIG. 4 shows a top view of front side 128 of a further exemplary embodiment of circular, disk-shaped milling head 126 having two radial corner recesses 130, each having a support surface 132 and two threaded bores 134 for receiving, in each case, a clamping bolt 136 for securing two identical, planar cutters 138. Cutters 138 are supported on their fronts at support surfaces 132. An arrow 12 indicates the direction of rotation of milling head 126, which is secured by a central retaining screw 144 on work spindle 13 of planer-type face milling machine 10 (FIG. 1).

Contiguous to radial supporting surfaces 132, from the viewpoint of the observer—following arrow 142—are, in each case, shaving grooves 146, configured as axial recesses, running radially on front surface 128, the shaving grooves promoting the removal of shavings during the use of milling head 126. Cutters 138 support only one secondary cutting edge 148, which is operative exclusively in the axial direction, i.e., protruding from the plane of the drawing, and not in the radial direction.

The radial external edge of cutter 138 determines the course of the effective circular path 152, which is only present geometrically and is not effective from the point of view of milling. The cutting point between a radial and the center of cutter 138 or the center of secondary cutting edge 148, determines working circle 154 situated radially to the inside. Working circle 154 describes the middle of a circular ring-shaped area, on which secondary cutting edge 148 effects a moving cut having the greatest surface quality.

Figure 5:
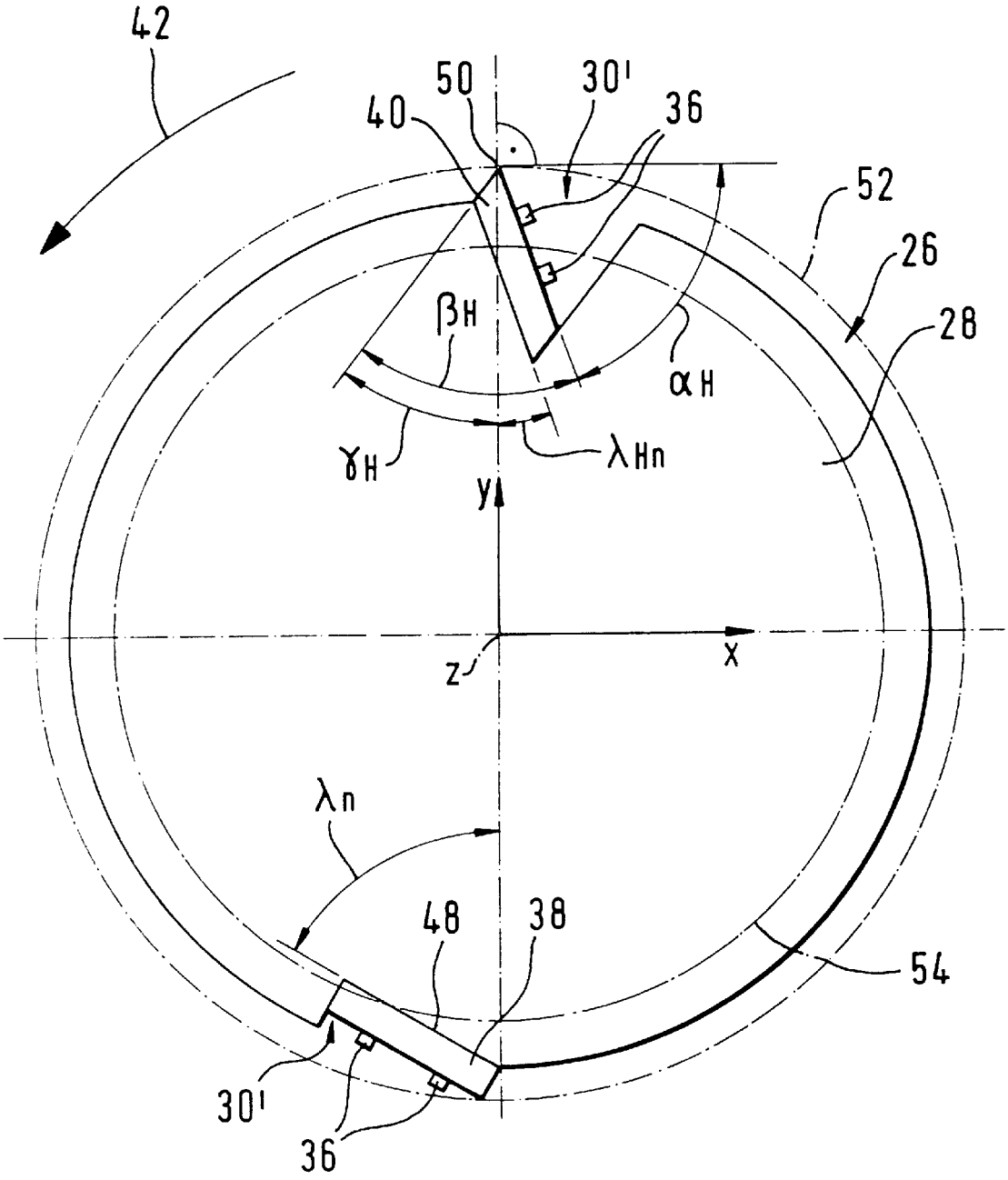
FIG. 5 shows the front side of a further milling head having two different cutters.

FIG. 5 shows a further exemplary embodiment of a milling head 26, which supports two different cutters 38,40, each in a radial recess 30'. The difference between first cutter 38 and second cutter 40, and their different tasks, are clear upon consideration of the angle of inclination in relation to a radial which runs in front side 28, or the plane of the circular path. In the middle on front side 28 of milling head 26 is depicted an x-y-z system of spatial coordinates, designed to facilitate comprehension of the technical solution.

Cutter 38, having only one single operative cutting edge, secondary cutting edge 48, is tilted in the x-y plane at the axis angle $\lambda n$ 45° to 75° with regard to the radial that intersects cutter 38 in the middle, working circle 54 of secondary cutting edge characterizing approximately the center of an annular area passed over by cutting edge 48 in one rotation. Cutter 40 also has only one single operative cutting edge, main cutting edge 50. The latter, analogously to the point of a tooth in a circular saw, is arranged radially to the outside at an angle of $\lambda Hn=0$ to 20° with regard to the radial that intersects the point.

Main cutting edge 50 has a wedge angle $\beta H<70°$, a setting angle $\alpha n$ of approximately 70°, and a negative effective cutting angle $\gamma H$ of approximately 30° degrees.

Figure 6:
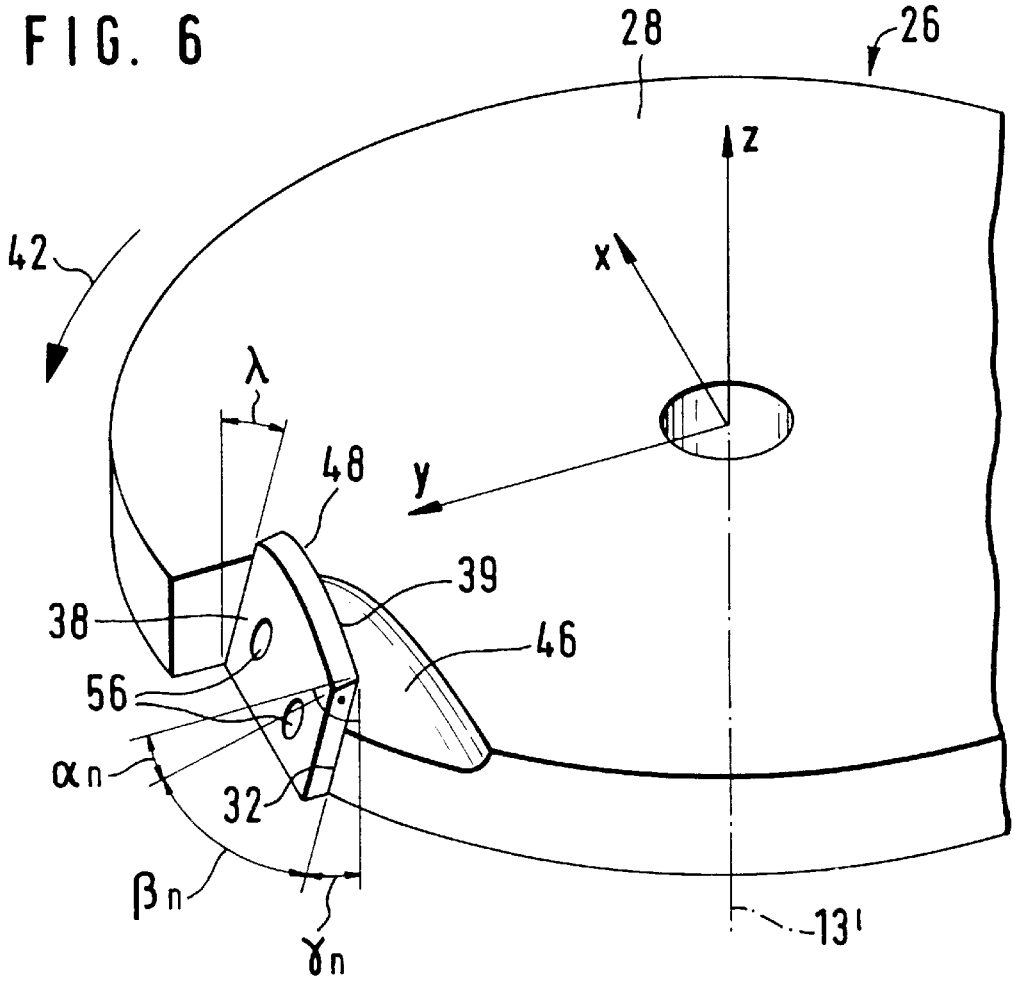
FIG. 6 shows a spatial partial view of a milling head.

FIG. 6 shows a schematically spatial representation of milling head 26 with the view of cutter 38 having only one operative secondary cutting edge 48 (and without a main cutting edge), the edge of radial support surface 32 on milling head 26 being clearly recognizable, cutter 38 having front 39 being supported on the radial supporting surface. The x-y-z coordinates according to FIG. 5 are also clear here. Cutter 38, tilted at an angle of $\lambda$ 20° with respect to milling axis 13', and in the y-z plane, supports through-openings 56 for undepicted retaining screws, which are screwed to milling head 26 and which, in this context, hold cutter 38 against supporting surface 32.

On the clothoid-shaped rounded secondary cutting edge 48, setting angle $\alpha n$, wedge angle $\beta n$, and effective cutting angle $\gamma n$ are clearly emphasized. Secondary cutting edge 48, formed as a cycloid or clothoid, effects a smooth clean surface in with entry into and removal from the workpiece surface, an extremely precisely peeled off shaving being attainable, which can be removed via shaving groove 46 of milling head 26. Through the choice of axis angle $\lambda n$, in a range of 45–70°, a moving cut is affected.

Figure 7:
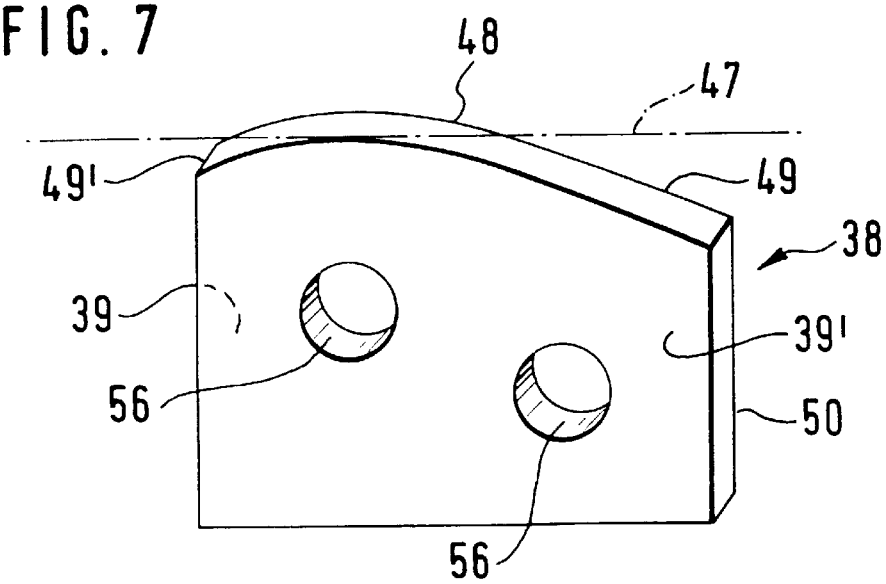
FIG. 7 shows a cutter having a clothoid-shaped secondary cutting edge of the milling head according to FIG. 2.

FIG. 7 shows cutter 38 as a detail having clothoid-shaped secondary cutting edge 48, which, roughly in the cutting point having the dot-dash line 47, passes over tangentially into circular or straight areas. Cutter back 39' supports two bores 56, whose geometric connecting line runs diagonally with respect to line 47. This arrangement of bores 56 is designed to effect a particularly reliable support of the cutter on milling head 26.

From the preceding explanations it is clear that the new features of the milling head and the planing cutter have their intended effect in planer-type face milling machines configured both as hand tool machines as well as stationary machines.

What is claimed is:

1. A planer-type face milling machine for processing wood, comprising:

at least one cutter arrangement including a cutter having only a secondary cutting edge having a clothoid-shaped contour;

a milling head having a front side supporting the at least one cutter arrangement, the at least one cutter arrangement being removably situated on the milling head;

a work spindle having a free end, the free end supporting the milling head; and a drive motor coupled to the work spindle.

2. The milling machine according to claim 1, wherein the at least one cutter arrangement includes a planar cutter.

3. The milling machine according to claim 1, wherein the milling machine is a hand tool machine.

4. The milling machine according to claim 3, wherein the hand tool machine includes a housing having a handle.

5. The milling machine according to claim 1, wherein the particular cutter is the only cutter supported by the milling head.

6. The milling machine according to claim 1, wherein the milling head is a disk-shaped body which runs parallel to a workpiece surface.

7. The milling machine according to claim 1, wherein the milling head supports a further cutter of the at least one cutter, the further cutter having only a main cutting edge.

8. The milling machine according to claim 7, wherein the cutter is secured on a side of the milling head, the further cutter being secured on another side of the milling head, the side being diametrically opposite to the another side.

9. The milling machine according to claim 8, wherein the at least one cutter includes a level planar body, the body being arranged on the milling head, a narrow side of the body pointing to a workpiece and protruding beyond the front side.

10. The milling machine according to claim 1, wherein the secondary cutting edge is situated at an axis angle between 45° and 75° with respect to a radial direction in an x-y plane, the x-y plane being determined by the front side of the milling head having a predetermined angle which is open in a direction of rotation.

11. The milling machine according to claim 10, wherein the cutter is situated on the milling head at an angle of inclination between 0° and 20°, the cutter pointing beyond the front side.

12. The milling machine according to claim 1, wherein the secondary cutting edge has an effective cutting angle between 20° and 30°.

13. The milling machine according to claim 1, wherein the secondary cutting edge has a wedge angle between 50° and 55°.

14. The milling machine according to claim 1, wherein the secondary cutting edge has a setting angle between 10° and 20°.

15. The milling machine according to claim 7, wherein the main cutting edge of the further cutter has a first length of 3 mm and enters into a workpiece surface, via the main cutting edge, and wherein the secondary cutting edge has a second length between 0.2 mm and 0.5 mm and protrudes axially for a distance which is equal to the second length extending beyond the main cutting edge.

16. The milling machine according to claim 15, wherein the secondary cutting edge protrudes axially in a z-direction.

17. The milling machine according to claim 15, wherein the main cutting edge has a first engagement line, the secondary cutting edge having a second engagement line, the first engagement line extending radially beyond the second engagement line.

18. The milling machine according to claim 17, wherein the first engagement line and the second engagement line define a work circle.

19. The milling machine according to claim 18, wherein the first engagement line extends radially beyond the second engagement line at a particular length which is approximately between 0.5 mm and 2 mm.

20. The milling machine according to claim 1, further comprising:

a base plate including a stationary part having a base, the work spindle and the milling head being tilted to a front portion of the machine with respect to the base in a particular direction, the particular direction extending along a feed path of the wood, wherein an external milling-head lower edge is defined by the main cutting edge and the secondary cutting edge, the lower edge extending to a rear portion of the machine under the base on a side of the machine.

* * * * *